US008302431B2

(12) United States Patent
Kimm et al.

(10) Patent No.: US 8,302,431 B2
(45) Date of Patent: Nov. 6, 2012

(54) METHOD AND APPARATUS FOR USING STEAM IN A COMMERCIAL LAUNDRY MACHINE AS AN ENVIRONMENTALLY-FRIENDLY REPLACEMENT OF CONVENTIONAL DRY CLEANING OR WET CLEANING PROCESSES

(75) Inventors: Dennis H. Kimm, San Jose, CA (US); Kenneth D. Lee, Cupertino, CA (US)

(73) Assignee: Green Solution, Inc., San Jose, CA (US)

( * ) Notice: Subject to any disclaimer, the term of this patent is extended or adjusted under 35 U.S.C. 154(b) by 506 days.

(21) Appl. No.: 12/477,149

(22) Filed: Jun. 3, 2009

(65) Prior Publication Data

US 2010/0306928 A1 Dec. 9, 2010

(51) Int. Cl.
*D06B 5/24* (2006.01)

(52) U.S. Cl. ..... 68/5 C; 68/12.12

(58) Field of Classification Search ..... 68/207; 8/149.3

See application file for complete search history.

(56) References Cited

U.S. PATENT DOCUMENTS

| | | | | | |
|---|---|---|---|---|---|
| 2,114,776 | A | * | 4/1938 | Davis | 68/18 R |
| 2,397,268 | A | * | 3/1946 | Jorgenson et al. | 68/58 |
| 2,527,392 | A | * | 10/1950 | Bradshaw | 55/308 |
| 2,573,966 | A | * | 11/1951 | Hamlin | 8/142 |
| 2,958,954 | A | * | 11/1960 | Longenecker | 34/527 |
| 3,049,903 | A | * | 8/1962 | Sussman | 68/5 C |
| 3,583,180 | A | * | 6/1971 | Arbogast | 68/5 C |
| 4,094,172 | A | * | 6/1978 | Arendt | 68/58 |
| 4,527,343 | A | * | 7/1985 | Danneberg | 34/452 |
| 4,580,421 | A | * | 4/1986 | Babuin et al. | 68/12.13 |
| 4,654,980 | A | * | 4/1987 | Bhat | 34/380 |
| 4,919,692 | A | * | 4/1990 | Vara et al. | 502/55 |
| 5,219,371 | A | * | 6/1993 | Shim et al. | 8/149.1 |
| 5,461,742 | A | * | 10/1995 | Pasad et al. | 8/149.2 |
| 5,651,276 | A | * | 7/1997 | Purer et al. | 68/5 C |
| 5,827,329 | A | * | 10/1998 | Champeau | 8/142 |
| 6,569,210 | B1 | * | 5/2003 | Chao et al. | 8/137 |
| 6,691,536 | B2 | * | 2/2004 | Severns et al. | 68/12.27 |
| 6,793,685 | B2 | * | 9/2004 | Noyes et al. | 8/149.2 |
| 6,889,399 | B2 | * | 5/2005 | Steiner et al. | 8/159 |
| 6,981,395 | B2 | * | 1/2006 | Ryu et al. | 68/17 R |
| 7,021,087 | B2 | * | 4/2006 | France et al. | 68/17 R |

(Continued)

FOREIGN PATENT DOCUMENTS

EP 1507028 A1 2/2005

(Continued)

*Primary Examiner* — Frankie L Stinson
(74) *Attorney, Agent, or Firm* — Invent Capture, LLC; Samuel S. Cho

(57) ABSTRACT

A commercial steam-cleaning laundry machine is configured to use steam instead of dry-cleaning chemicals or water as a primary cleaning agent for garments rotating in a drum of the commercial steam-cleaning laundry machine. In one embodiment of the invention, a steam injector at least partially exposed to an inner surface of the drum is configured to provide a MCU-controlled fresh steam injection into the drum during a cleaning cycle of the commercial steam-cleaning laundry machine. The fresh steam into the commercial steam-cleaning laundry machine is from an outtake of a standalone boiler system which is typically used for a variety of fabric treatment machines in a commercial laundry operation. A debris and clean steam/air separation chamber periodically or continuously separates and/or filters debris, chemicals, and/or other undesirable elements from the drum and evacuates clean or cleaned-up air and moistures to an air-out duct.

18 Claims, 9 Drawing Sheets

U.S. PATENT DOCUMENTS

| | | | | |
|---|---|---|---|---|
| 7,406,842 | B2 | 8/2008 | Oh et al. | |
| 7,490,493 | B2 | 2/2009 | Kim et al. | |
| 2009/0120140 | A1* | 5/2009 | Choi et al. | 68/5 |
| 2009/0255146 | A1* | 10/2009 | Klug et al. | 34/491 |
| 2009/0282695 | A1* | 11/2009 | Kreutzfeldt et al. | 34/443 |
| 2010/0011606 | A1* | 1/2010 | Kim et al. | 34/60 |

FOREIGN PATENT DOCUMENTS

| | | | | |
|---|---|---|---|---|
| EP | 1507032 | A1 | | 2/2005 |
| EP | 1746196 | A2 | | 1/2007 |
| JP | 02-239894 | | * | 9/1990 |
| JP | 10-235088 | | * | 9/1998 |
| JP | 11-226290 | | * | 8/1999 |
| JP | 2005-118611 | | * | 5/2005 |
| JP | 2006-311883 | | * | 11/2006 |
| JP | 2007-117377 | | * | 5/2007 |
| KR | 672438 | | * | 1/2007 |
| KR | 672439 | | * | 1/2007 |

* cited by examiner

400

500

600

700

-Prior Art-

A Conventional Wet Cleaning Process in a Commercial Laundry Operation

METHOD AND APPARATUS FOR USING STEAM IN A COMMERCIAL LAUNDRY MACHINE AS AN ENVIRONMENTALLY-FRIENDLY REPLACEMENT OF CONVENTIONAL DRY CLEANING OR WET CLEANING PROCESSES

BACKGROUND

For more than a century, commercial laundry industry has confronted a variety of technical challenges. Historically, a typical commercial laundry operation has been expected to handle a variety of fabric types that may be difficult to clean at a typical household. A "dry clean" process was invented in the mid-19$^{th}$ century and became a symbol of the commercial laundry industry. The dry clean process uses chemical agents instead of water and is effective in cleaning wool, silk, fur, and other fabric types which are difficult to clean with water. A first generation of dry cleaning methods generally used petrochemical solvents such as kerosene and even gasoline. Because kerosene and gasoline were found to be excessively flammable and outright dangerous for use in a commercial laundry facility, less flammable petrochemical agents such as a paraffin-derived "Stoddard solvent" were widely used until the 1950's.

The petrochemical solvents used in the first generation of dry cleaning were still frequently susceptible to fire and explosions, and a safer dry-cleaning solvent was need in the industry. Starting in the 1930's, tetrachloroethylene, also known as perchloroethylene or "perc" in short, was discovered to be a very effective and non-flammable dry-cleaning agent. Perc was also gentle to many sensitive garments such as silk and wool. The use of perc in dry cleaning became a defacto industry standard by the mid-20$^{th}$ century and still is a common choice for dry cleaning operations.

However, in the 1990's, tetrachloroethylene was declared to be a carcinogen against humans and a contaminating agent on the Earth's atmosphere. For example, in 1993, the California Air Resources Board devised an airborne toxic control measure to reduce perc emissions from commercial laundry facilities. Many commercial laundry facilities today face strict environmental standard restrictions and even a general phase-out of perc-based dry cleaning machines Although more eco-friendly chemical agents such as glycol ethers and decamethylcyclopentasiloxane (D5) were devised, increasingly stringent environmental regulations against any chemical dry-cleaning agents and a high cost of operation and equipment have prevented the commercial laundry industry from rapidly adopting such eco-friendly alternatives.

An undesirable alternative to dry cleaning is simply a "wet clean" process, which agitates garments immersed in water with an injection of biodegrable detergents, similar to a modern household washing machine which uses water. Unfortunately, the wet clean process is very undesirable in a commercial laundry operation because only a limited number of fabric types can be treated with a wet-cleaning machine. Furthermore, even fabric types which can be washed with water experience an unacceptable level of shrinkage, wrinkling, and/or damage to garments in a high-volume commercial laundry operation. A laundry facility using water-based wet-cleaning machine inevitably spends an exorbitant amount of time for mitigating shrinkage and wrinkling of garments before a garment press machine can be used. Furthermore, the cost of a water-based wet cleaning machine tends to be even more expensive than a dry cleaning machine.

Therefore, a novel apparatus and a method to provide a cost-effective and environmentally-friendly cleaning of a variety of fabric types with a minimal environmental regulations in a commercial laundry facility is highly desirable.

SUMMARY

Summary and Abstract summarize some aspects of the present invention. Simplifications or omissions may have been made to avoid obscuring the purpose of the Summary or the Abstract. These simplifications or omissions are not intended to limit the scope of the present invention.

In one embodiment of the invention, a commercial steam-cleaning laundry machine configured to use steam as a primary cleaning agent for garments is disclosed. The commercial steam-cleaning laundry machine comprises a drum operatively connected to a front-loading door and a drum motor of the commercial steam-cleaning laundry machine, wherein the drum is configured to rotate inside the commercial steam-cleaning laundry machine by a rotational force provided by the drum motor; a steam injector at least partially exposed to an inner surface of the drum, wherein the steam injector is configured to provide a microcontroller (MCU)-controlled fresh steam injection into the drum during a cleaning cycle of the commercial steam-cleaning laundry machine; a steam-in duct operatively connected to the steam injector and an external water boiler system outside the commercial steam-cleaning laundry machine, wherein the steam-induct is configured to carry fresh steam produced from the external boiler system outside the commercial steam-cleaning laundry machine into the steam injector of the commercial steam-cleaning laundry machine; a control panel operatively connected to the microcontroller (MCU) of the commercial steam-cleaning laundry machine, wherein the control panel enables a user to select, initiate, or halt a particular garment-cleaning program using steam as the primary cleaning agent; an air-in duct operatively connected to the drum, wherein the air-in duct is configured to bring fresh outside air continuously or periodically during an operation of the particular garment-cleaning program; a debris and clean steam/air separation chamber operatively connected to an outtake port inside the drum, wherein the debris and clean steam/air separation chamber is designed to separate, filter, and/or clean an incoming mixture of debris, steam, moisture, chemicals and/or air from the drum; and an air-out duct operatively connected to the debris and clean steam/air separation chamber, wherein the air-out duct is configured to evacuate filtered and/or cleaned steam, air, and/or condensed water from the debris and clean steam/air separation chamber.

Furthermore, in another embodiment of the invention, a commercial steam-cleaning laundry machine configured to use steam as a primary cleaning agent for garments is also disclosed. This commercial steam-cleaning laundry machine comprises a drum operatively connected to a front-loading door and a drum motor of the commercial steam-cleaning laundry machine, wherein the drum is configured to rotate inside the commercial steam-cleaning laundry machine by a rotational force provided by the drum motor; a first steam injector and a second steam injector at least partially exposed to an inner surface of the drum, wherein the first steam injector and the second steam injector are configured to provide a microcontroller (MCU)-controlled fresh steam injection into the drum during a cleaning cycle of the commercial steam-cleaning laundry machine; a steam-in duct operatively connected to the first steam injector, the second steam injector, and an external water boiler system outside the commercial steam-cleaning laundry machine, wherein the steam-induct is configured to carry fresh steam produced from the external boiler system outside the commercial steam-cleaning laundry machine into the first steam injector and the second steam injector of the commercial steam-cleaning laundry machine; a control panel operatively connected to the microcontroller (MCU) of the commercial steam-cleaning laundry machine, wherein the control panel enables a user to select, initiate, or halt a particular garment-cleaning program using steam as the primary cleaning agent; an air-in duct operatively connected to the drum, wherein the air-in duct is configured to bring fresh outside air continuously or periodically during an operation of the particular garment-cleaning program; a debris and clean steam/air separation chamber operatively connected to an outtake port inside the drum, wherein the debris and clean steam/air separation chamber is designed to separate, filter, and/or clean an incoming mixture of debris, steam, moisture, chemicals and/or air from the drum; and an air-out duct operatively connected to the debris and clean steam/air separation chamber, wherein the air-out duct is configured to evacuate filtered and/or cleaned steam, air, and/or condensed water from the debris and clean steam/air separation chamber.

Moreover, in another embodiment of the invention, a method for using steam in a steam-cleaning laundry machine is disclosed. This method comprises rotating a drum in a steam-cleaning laundry machine to provide dust filtering and loosening of garments; transmitting fresh steam from a standalone water boiler system used in a commercial laundry operation to the steam-cleaning laundry machine using a steam-in duct; injecting a predetermined amount of the fresh steam into the drum of the steam-cleaning laundry machine while the drum containing the garments continue to rotate, wherein the predetermined amount of the fresh steam is calculated by a particular garment cleaning program a user selected; adding detergent and/or fabric conditioner into the drum; circulating air into and out of the drum for each clean cycle periodically or continuously, wherein the step of circulating the air into and out of the drum also assists evacuation of moistures, chemicals, and/or debris from the drum; raising an internal temperature of the drum for a press-friendly preliminary drying of the garments; and continuing to rotate the drum in the steam-cleaning laundry machine until a last air circulation from the steam-cleaning laundry machine is complete.

DETAILED DESCRIPTION

Figure 1:
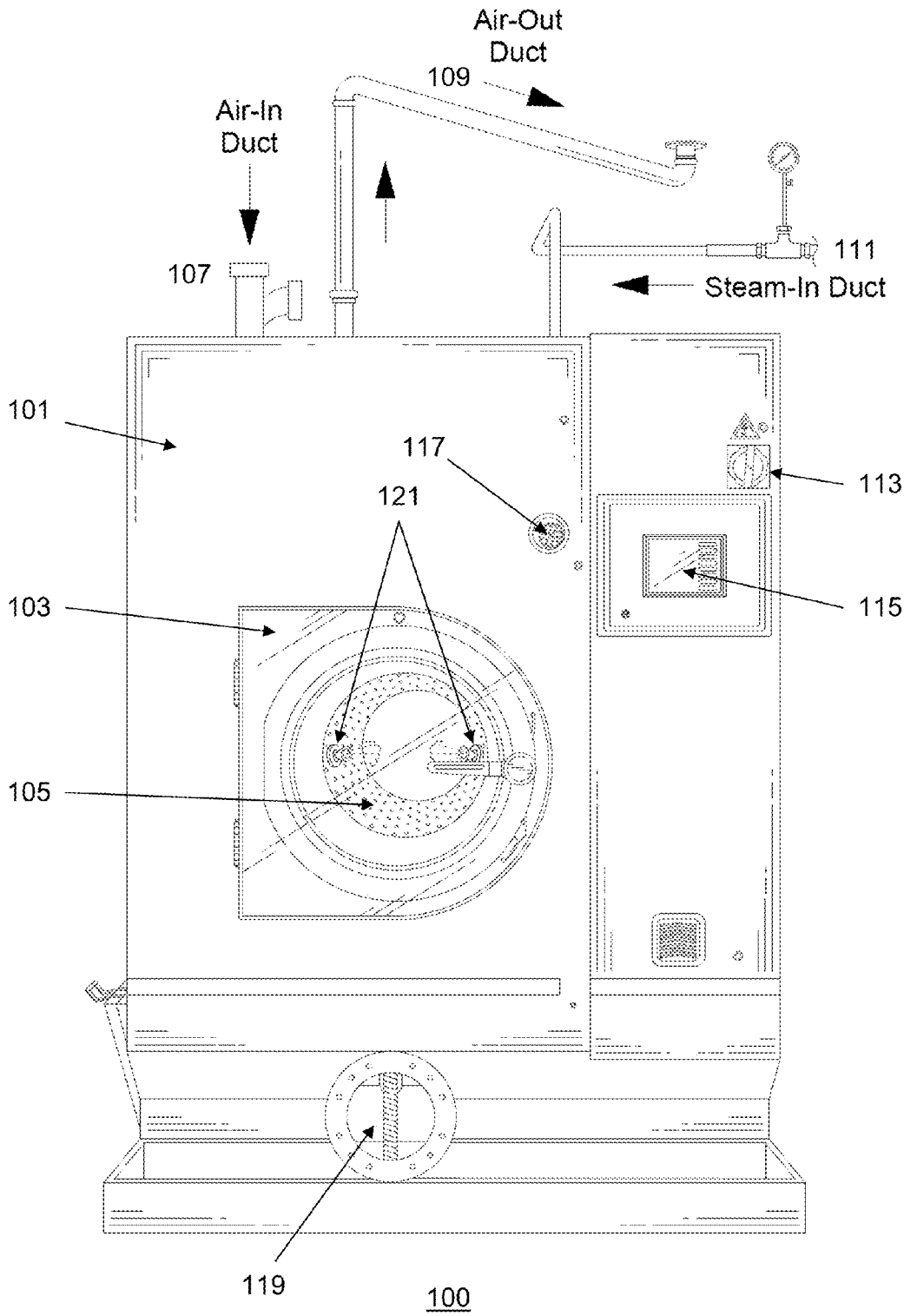
FIG. 1 shows a front view of a commercial steam-cleaning laundry machine configured to use steam as a primary cleaning agent in accordance of an embodiment of the invention.

Specific embodiments of the invention will now be described in detail with reference to the accompanying figures. Like elements in the various figures are denoted by like reference numerals for consistency.

In the following detailed description of the present invention, numerous specific details are set forth in order to provide a thorough understanding of the present invention. However, it will become obvious to those skilled in the art that the present invention may be practiced without these specific details. In other instances, well known methods, procedures, and/or components have not been described in detail to avoid unnecessarily obscuring aspects of the present invention. The detailed description is presented largely in terms of procedures, logic blocks, processing, and/or other symbolic representations that directly or indirectly resemble a commercial steam-cleaning laundry machine as an environmentally-friendly replacement of conventional dry or wet cleaning processes. These descriptions and representations are the means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

This invention generally relates to laundry machines. More specifically, the present invention relates to using steam instead of conventional dry cleaning or wet cleaning processes for cleaning a laundry load in a high-volume commercial laundry operation. Furthermore, the present invention relates to a method and an apparatus for using steam as an environmentally-friendly cleaning agent. In addition, the present invention also relates to providing a laundry press machine-friendly cleaning of garments by minimizing fabric shrinkage and damage, especially compared to a conventional wet-cleaning process.

FIG. 1 shows a front view (100) of a commercial steam-cleaning laundry machine (101) configured to use steam as a primary cleaning agent in accordance of an embodiment of the invention. In a preferred embodiment of the invention, the commercial steam-cleaning laundry machine (101) has a drum (105) with micro-holes and one or more steam injectors (121) which are at least partially exposed to an inner surface of the drum. In one embodiment of the invention, the micro-holes enable more effective cleaning of a laundry load when the drum rotates laterally by accommodating a plurality of air pockets and randomized patterns of steam and moisture movements. Furthermore, the one or more steam injectors (121) are configured to provide a microcontroller (MCU)-controlled fresh steam injection into the drum during a cleaning and/or rinsing cycle of the commercial steam-cleaning laundry machine (101).

In a preferred embodiment of the invention, the one or more steam injectors (121) are operatively connected to a steam-in duct (111) which transports fresh steam produced from an external boiler system outside the commercial steam-cleaning laundry machine (101) into the steam injector of the commercial steam-cleaning laundry machine. In one embodiment of the invention, a pressure level of the incoming fresh steam is controlled by a pressure valve operatively connected to the steam-in duct (111). Furthermore, in one embodiment of the invention, the one or more steam injectors (121) and/or the pressure valve operatively connected to the steam-in duct (111) can be enabled, disabled, and/or pressure-controlled (i.e. adjusted to a different pressure level) by the MCU of the commercial steam-cleaning laundry machine (101) which is executing a particular garment cleaning program (e.g. whites, bright-colors, silk-only, wool-only, and etc.). The particular garment cleaning program can be controlled by a user via a control panel (115) operatively connected to the MCU of the commercial steam-cleaning laundry machine (101). One example of the control panel (115) is a touch-screen graphical user interface. Another example of the control panel (115) is a physical button/display combo interface. A plurality of garment cleaning programs is typically programmed into the commercial steam-cleaning laundry machine for a varying duration of clean and rinse cycles and a varying amount of steam injections into the drum. In a preferred embodiment of the invention, the garment cleaning programs are categorized by colors of a laundry load (e.g. whites, bright colors, dark colors, and etc.). In general, a lighter-color laundry load requires more time for cleaning cycles and more steam injections into the drum than a darker-color laundry load.

Continuing with FIG. 1, during each cleaning cycle, a periodic or a continuous air circulation and debris removal keeps steam cleaning of garments inside the drum more effective and refreshed while minimizing odor inside the drum (105). In a preferred embodiment of the invention, a fresh air is brought into the drum by an air-in duct (107) while a mixture of used air, steam, and/or moistures may exit through an air-out duct (109). As an optional measure, a filtering and/or a separation process for debris, chemicals, dirty steam, and/or dirty moistures can be performed prior to the evacuation of cleaner and/or cleaned-up air through the air-out duct (109). In the preferred embodiment of the invention, the drum (105) also has a front-loading door (103) with a viewing area to inspect a laundry load inside. The front-loading door (103) is typically made of metal and glass materials to resist heat and mechanical stress during an operating life of the commercial steam-cleaning laundry machine (101). In addition, the commercial steam-cleaning laundry machine (101) in FIG. 1 can have a device active/inactive indicator (117) which conveniently indicates whether the commercial steam-cleaning laundry machine (101) is currently active or inactive even when a user is too far away to read specific information on a user interface of the control panel (115).

Furthermore, in one embodiment of the invention as shown in FIG. 1, a main power or an emergency on/off switch (113) allows a user to enable or disable power supply to the commercial steam-cleaning laundry machine (101) directly, thereby allowing the user to bypass menu choices in the control panel (115) to control the power supply immediately in case of an urgent need or emergency. Moreover, in one embodiment of the invention, a reserve tank (119) is also operatively connected to the drum (105), the steam-in duct (111), the air-in duct (107), and/or the air-out duct (109) for assisting cleaning and/or rinsing cycles of the commercial steam-cleaning laundry machine (101).

Figure 2:
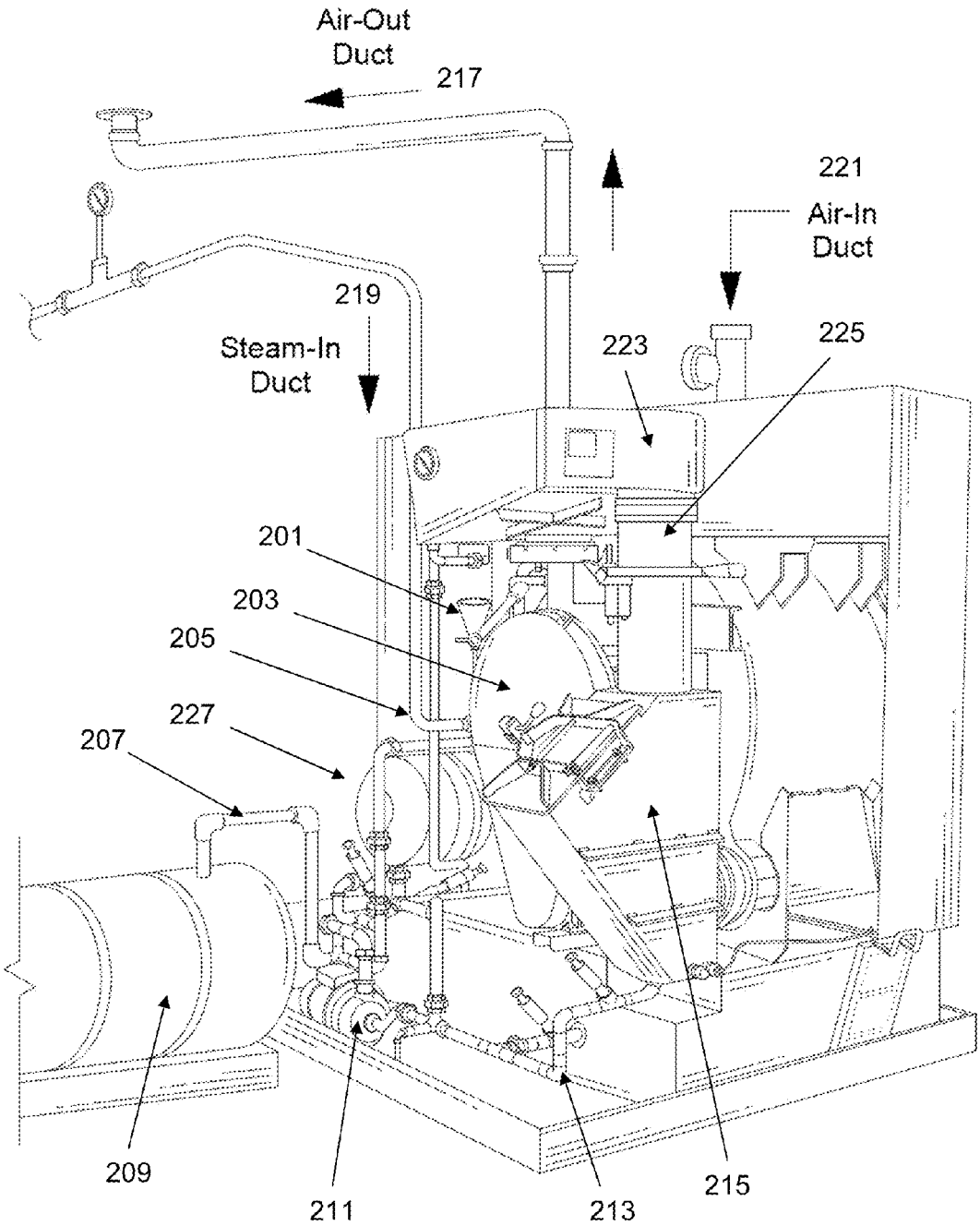
FIG. 2 shows a perspective side-rear view of a commercial steam-cleaning laundry machine configured to use steam as a primary cleaning agent in accordance with an embodiment of the invention.

FIG. 2 shows a perspective side-rear view of a commercial steam-cleaning laundry machine (200) configured to use steam as a primary cleaning agent in accordance with an embodiment of the invention. In a preferred embodiment of the invention, the commercial steam-cleaning laundry machine (200) has a detergent/fabric conditioner input port (201), a drum motor enclosure (203) containing an electrical drum motor for providing a rotational force for a drum (e.g. 105) of the commercial steam-cleaning laundry machine (200), and a steam-in duct (205) operatively connected to an external water boiler system and a steam injector of the commercial steam-cleaning laundry machine (200). In addition, the preferred embodiment of the invention also has a debris and clean steam/air separation chamber (215) operatively connected to an outtake port inside the drum. The debris and clean steam/air separation chamber (215) is designed to separate, filter, and/or clean an incoming mixture of debris, steam, moisture, chemicals, and/or air from the outtake port of the drum.

In the preferred embodiment of the invention, the debris and clean steam/air separation chamber (215) is also operatively connected to a debris collection pipe (213), a debris pump motor (211), a debris container pipe (207), and a debris container (209). In one embodiment of the invention, filters inside the debris and clean steam/air separation chamber (215) separates and drops debris, dirty moisture, and other undesirable elements down to the debris collection pipe (213), which transports waste products to the debris container (209). In the preferred embodiment of the invention, the debris pump motor (211) is used somewhere between the debris collection pipe (213) and the debris container pipe (207) to provide a sufficient pressure to transport the waste products to the debris container (209). Furthermore, in the preferred embodiment of the invention, the debris and clean steam/air separation cylinder (225) is used in conjunction with the debris and clean steam/air separation chamber (215) to provide an additional level of filtering, cleaning, and/or separation of undesirable or environmentally harmful debris, steam, moisture, chemicals, and/or air.

In another embodiment of the invention, debris, dirty moisture, and other undesirable elements separated and "dropped down" by the debris and clean steam/air separation chamber (215) is sent to a disk filter/distillation tank unit (227) instead of the debris container (209). In this alternative embodiment of the invention, the debris collection pipe (213) and/or the debris pump motor (211) can be operatively connected to the disk filter/distillation tank unit (227) instead of the debris container (209). The disk filter/distillation tank unit (227) is designed to separate debris, dirt, and/or chemicals from moistures. The disk filter/distillation tank unit (227) then boils and evaporates clean or "cleaned-up" moistures through a "steam-out" duct. This steam-out duct can be a same duct as the air-out duct (217) or a separate duct. One method of moisture evaporation from the disk filter/distillation tank unit (227) uses a steam-based heat coil to evaporate clean or cleaned-up moistures rapidly through the "steam-out" duct. An advantage of this alternative embodiment of the invention using the disk filter/distillation tank unit (227) over the preferred embodiment using the debris container (209) is an elimination of wastewater sewage, which typically accumulates in the debris container (209) in case of the preferred embodiment. A user may have easier time cleaning up the disk filter/distillation tank unit (227) than cleaning up the debris container (209) because the leftover debris and dirt are dried-out in the disk filter/distillation tank unit (227) after the evaporation of the clean or cleaned-up moistures. Furthermore, there may be less environmental pollution in the alternative embodiment, because the wastewater sewage does not get dumped into an open drain. Because a major objective of the disk filter/distillation tank unit (227) is to evaporate clean or cleaned-up moistures only to an external duct, air pollution prospects due to the use of the disk filter/distillation tank unit (227) is minimal in the alternative embodiment of the invention.

Continuing with FIG. 2, a continuous or a periodic air circulation is provided to the drum of the commercial steam-cleaning laundry machine (200) by an air-in duct (221) and an air-out duct (217). In a preferred embodiment of the invention, a clean steam/air blower (223) is operatively connected to the debris and clean steam/air cylinder (225) and the air-out duct (217), and the clean steam/air blower (223) is designed to provide a sufficient force to push clean or cleaned steam and/or air to the air-out duct (217).

A significant advantage of the present invention is that the use of steam as a primary agent with a built-in exhaustive material filtering feature (e.g. a debris and clean steam/air separation chamber (215), a debris container (209), and etc.) enables an eco-friendly evacuation of clean or "cleaned-up" air and steam to the environment. Not only does a novel commercial steam-cleaning laundry machine (e.g. 101, 200) disclosed in the present invention provide an environmentally-friendly solution to the commercial laundry industry, but it also reduces operating costs of a commercial laundry facility by minimizing pollution-related regulatory procedures. In contrast, a chemical-based (e.g. perc) dry cleaning machine faces increasingly stringent environmental restrictions, inspections, and equipment costs which act as a time-consuming and substantial cost overhead to an overall profitability of a commercial laundry.

Furthermore, another significant advantage of the present invention is that the commercial steam-cleaning laundry machine (e.g. 101, 200) typically requires substantially smaller amount of water usage relative to a conventional, water-based "wet cleaning" machine A resulting water conservation achieved by the present invention is another critical factor in preserving the environment, especially in parts of the world (e.g. arid western parts of the United States such as California, Arizona, New Mexico, and Nevada) with relatively scarce regional water resources. Equally important, cleaned garments from the commercial steam-cleaning laundry machine typically experience less wrinkles and shrinkages compared to the conventional water-based wet cleaning machines, which translates to less preparation time and effort prior to using a laundry press machine for garments in a commercial laundry operation.

In addition, it should be noted that most wet cleaning machines in the market today require a refrigeration unit for cooling and drying a laundry load, which add manufacturing costs and ultimately an end-product cost to a commercial laundry owner. In contrast, the commercial steam-cleaning laundry machine (e.g. 101, 200) disclosed in the present invention does not require many of the extraneous components such as the refrigeration unit, thereby resulting in cost savings for its manufacturer and customers. Moreover, by utilizing an external water boiler system which is typically present anyway in a commercial laundry facility due to the necessity of the external water boiler system for laundry press machines, the commercial steam-cleaning laundry machine (e.g. 101, 200) does not have to embed an internal water boiler unit. The use of the internal water boiler unit for steam generation would have been expensive to operate in case of an embedded electrical boiler due to the cost of electricity for heating water, or expensive to manufacture and operate in case of an embedded gas-fired water boiler. Therefore, a novel utilization of an existing external water boiler system in a commercial laundry facility for steam intake in a novel commercial steam-cleaning laundry machine as devised in the present invention further achieves cost savings for its manufacturer and customers.

Figure 3:
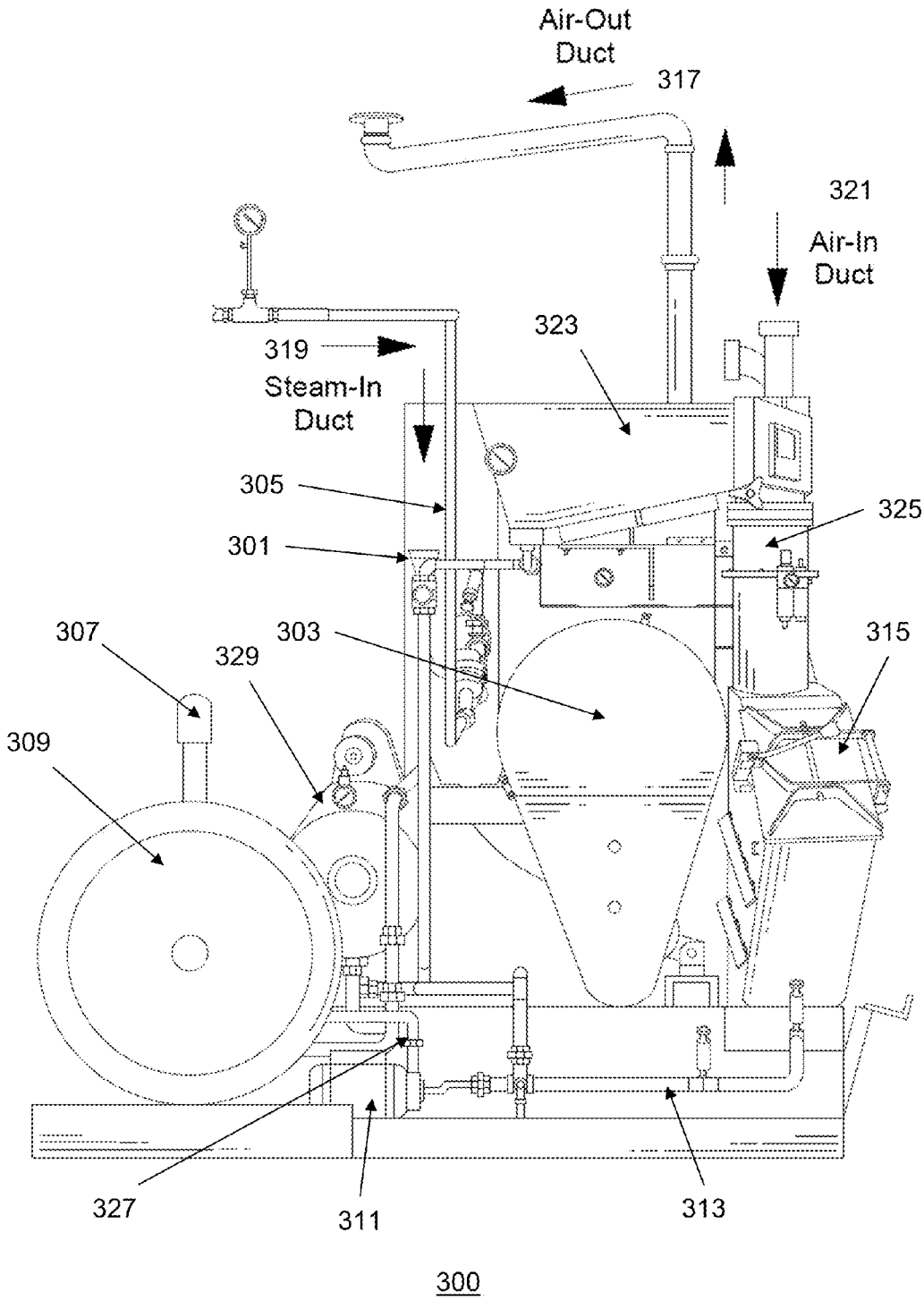
FIG. 3 shows a rear view of a commercial steam-cleaning laundry machine configured to use steam as a primary cleaning agent in accordance with an embodiment of the invention.

FIG. 3 shows a rear view of a commercial steam-cleaning laundry machine (300) configured to use steam as a primary cleaning agent in accordance with an embodiment of the invention. In a preferred embodiment of the invention, the commercial steam-cleaning laundry machine (300) has a detergent/fabric conditioner input port (301), a drum motor enclosure (303) containing an electrical drum motor for providing a rotational force for a drum (e.g. 105) of the commercial steam-cleaning laundry machine (300), and a steam-in duct (305, 319) operatively connected to an external water boiler system and a steam injector of the commercial steam-cleaning laundry machine (300). In addition, the preferred embodiment of the invention also has a debris and clean steam/air separation chamber (315) operatively connected to an outtake port inside the drum. The debris and clean steam/air separation chamber (315) is designed to separate, filter, and/or clean an incoming mixture of debris, steam, moisture, chemicals, and/or air from the outtake port of the drum.

In the preferred embodiment of the invention, the debris and clean steam/air separation chamber (315) is also operatively connected to a debris collection pipe (313), a debris pump motor (311), a debris container pipe (327, 307), and a debris container (309). In one embodiment of the invention, filters inside the debris and clean steam/air separation chamber (315) separates and drops debris, dirty moisture, and other undesirable elements down to the debris collection pipe (313), which transports waste products to the debris container (309). In the preferred embodiment of the invention, the debris pump motor (311) is used somewhere between the debris collection pipe (313) and the debris container pipe (307) to provide a sufficient pressure to transport the waste products to the debris container (309). Furthermore, in the preferred embodiment of the invention, the debris and clean steam/air separation cylinder (325) is used in conjunction with the debris and clean steam/air separation chamber (315) to provide an additional level of filtering, cleaning, and/or separation of undesirable or environmentally harmful debris, steam, moisture, chemicals, and/or air.

In another embodiment of the invention, debris, dirty moisture, and other undesirable elements separated and "dropped down" by the debris and clean steam/air separation chamber (315) is sent to a disk filter/distillation tank unit (329) instead of the debris container (309). In this alternative embodiment of the invention, the debris collection pipe (313) and/or the debris pump motor (311) can be operatively connected to the disk filter/distillation tank unit (329) instead of the debris container (309). The disk filter/distillation tank unit (329) is designed to separate debris, dirt, and/or chemicals from moistures. The disk filter/distillation tank unit (329) then boils and evaporates clean or "cleaned-up" moistures through a "steam-out" duct. This steam-out duct can be a same duct as the air-out duct (317) or a separate duct. One method of moisture evaporation from the disk filter/distillation tank unit (329) uses a steam-based heat coil to evaporate clean or cleaned-up moistures rapidly through the "steam-out" duct. An advantage of this alternative embodiment of the invention using the disk filter/distillation tank unit (329) over the preferred embodiment using the debris container (309) is an elimination of wastewater sewage, which typically accumulates in the debris container (309) in case of the preferred embodiment. A user may have easier time cleaning up the disk filter/distillation tank unit (329) than cleaning up the debris container (309) because the leftover debris and dirt are dried-out in the disk filter/distillation tank unit (329) after the evaporation of the clean or cleaned-up moistures. Furthermore, there may be less environmental pollution in the alternative embodiment, because the wastewater sewage does not get dumped into an open drain. Because a major objective of the disk filter/distillation tank unit (329) is to evaporate clean or cleaned-up moistures only to an external duct, air pollution prospects due to the use of the disk filter/distillation tank unit (329) is minimal in the alternative embodiment of the invention.

Continuing with FIG. 3, a continuous or a periodic air circulation is provided to the drum of the commercial steam-cleaning laundry machine (300) by an air-in duct (321) and an air-out duct (317). In a preferred embodiment of the invention, a clean steam/air blower (323) is operatively connected to the debris and clean steam/air cylinder (325) and the air-out duct (317), and the clean steam/air blower (323) is designed to provide a sufficient force to push clean or cleaned steam and/or air to the air-out duct (317).

Figure 4:
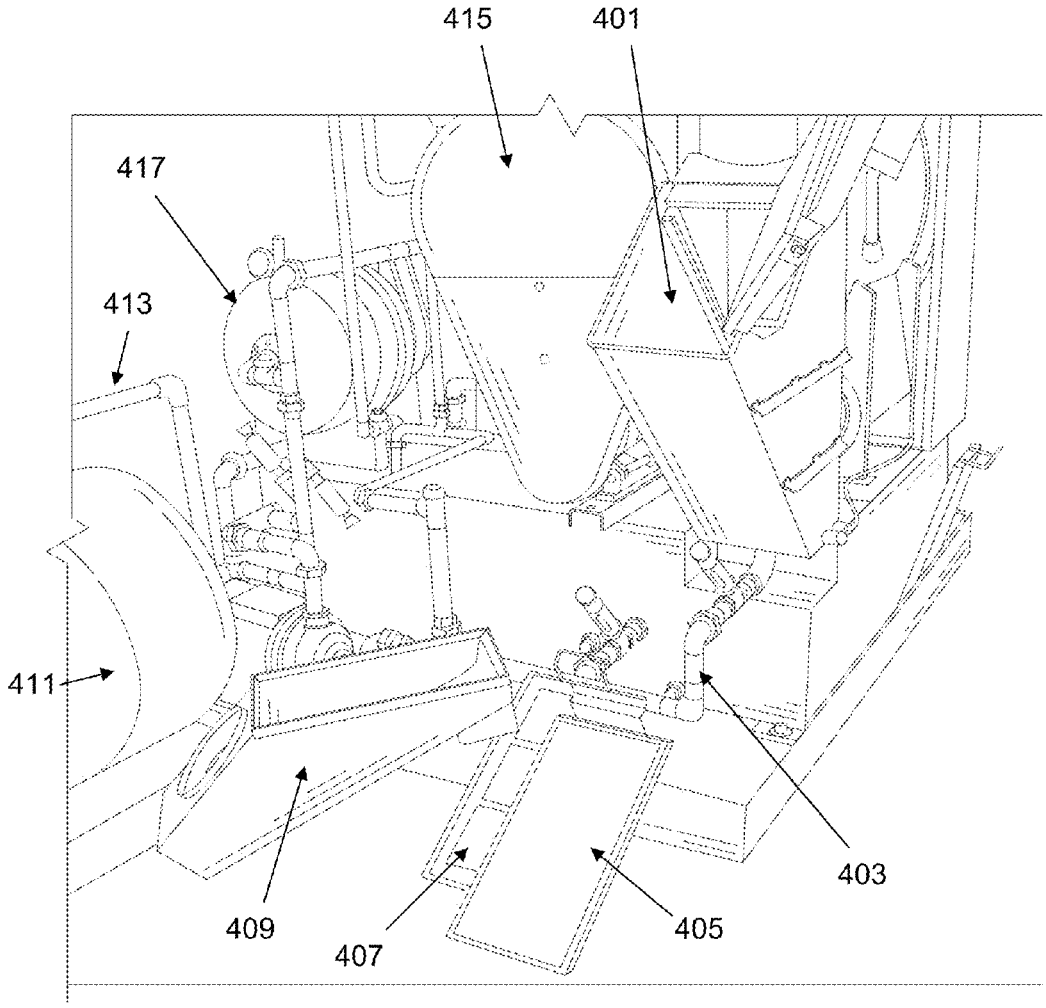
FIG. 4 shows a partial rear view of a commercial steam-cleaning laundry machine with disassembled parts from a debris and clean steam/air separation chamber, in accordance with an embodiment of the invention.

FIG. 4 shows a partial rear view of a commercial steam-cleaning laundry machine (400) with disassembled parts (e.g. 405, 407, 409) from a debris and clean steam/air separation chamber (401), in accordance with an embodiment of the invention. The partial rear view in FIG. 4 also shows a rear view of a drum motor enclosure (415). As described previously, the debris and clean steam/air separation chamber (401) is capable of separating, filtering, and/or cleaning an incoming mixture of debris, steam, moisture, chemicals, and/or air from a drum of the commercial steam-cleaning laundry machine (400). In a preferred embodiment of the invention, the debris and clean steam/air separation chamber (401) includes one or more filters (405, 407) to achieve separation, filtering, and cleaning of the incoming mixture of debris, steam, moisture, chemicals, and/or air from the drum.

In one embodiment of the invention, a first debris and clean steam/air filter (405) is disassembled view of a high-efficiency particulate air (HEPA) filter which is configured to capture undesirable debris and other elements to prevent evacuation to an air-out duct. The HEPA filter can also prevent clogging of a debris collection pipe (403) and a debris container pipe (413) by intercepting large debris which otherwise could have clogged the debris collection pipe (403) and the debris container pipe (413). In one embodiment of the invention, a second debris and clean steam/air filter (407) is disassembled view of a carbon filter which can purify dirty steam, moisture, chemicals, and/or air so that only acceptably clean and filtered steam, moisture, and air can escape to the environment via an air-out duct.

Continuing with FIG. 4, in a preferred embodiment of the invention, waste products which are not captured by the first and the second debris and clean steam/air filters (405, 407) can be flushed down to a debris container (411) via the debris collection pipe (403) and the debris container pipe (413). In another embodiment of the invention, the waste products separated and "dropped down" by the debris and clean steam/air separation chamber (401) is sent to a disk filter/distillation tank unit (417) instead of the debris container (411). In this alternative embodiment of the invention, the debris collection pipe (403) and/or the debris pump motor can be operatively connected to the disk filter/distillation tank unit (417) instead of the debris container (411). The disk filter/distillation tank unit (417) is designed to separate debris, dirt, and/or chemicals from moistures. The disk filter/distillation tank unit (417) then boils and evaporates clean or "cleaned-up" moistures through a "steam-out" duct. This steam-out duct can be a same duct as the air-out duct or a separate duct. One method of moisture evaporation from the disk filter/distillation tank unit (417) uses a steam-based heat coil to evaporate clean or cleaned-up moistures rapidly through the "steam-out" duct. An advantage of this alternative embodiment of the invention using the disk filter/distillation tank unit (417) over the preferred embodiment using the debris container (411) is an elimination of wastewater sewage, which typically accumulates in the debris container (411) in case of the preferred embodiment. A user may have easier time cleaning up the disk filter/distillation tank unit (417) than cleaning up the debris container (411) because the leftover debris and dirt are dried-out in the disk filter/distillation tank unit (417) after the evaporation of the clean or cleaned-up moistures. Furthermore, there may be less environmental pollution in the alternative embodiment, because the wastewater sewage does not get dumped into an open drain. Because a major objective of the disk filter/distillation tank unit (417) is to evaporate clean or cleaned-up moistures only to an external duct, air pollution prospects due to the use of the disk filter/distillation tank unit (417) is minimal in the alternative embodiment of the invention.

In one embodiment of the invention, a chamber filter container (409) fits into the debris and clean steam/air separation chamber (401) in an assembled mode, wherein the chamber filter container (409) is configured to contain or encapsulate one or more filters (e.g. 405, 407) in the assembled mode.

Figure 5:
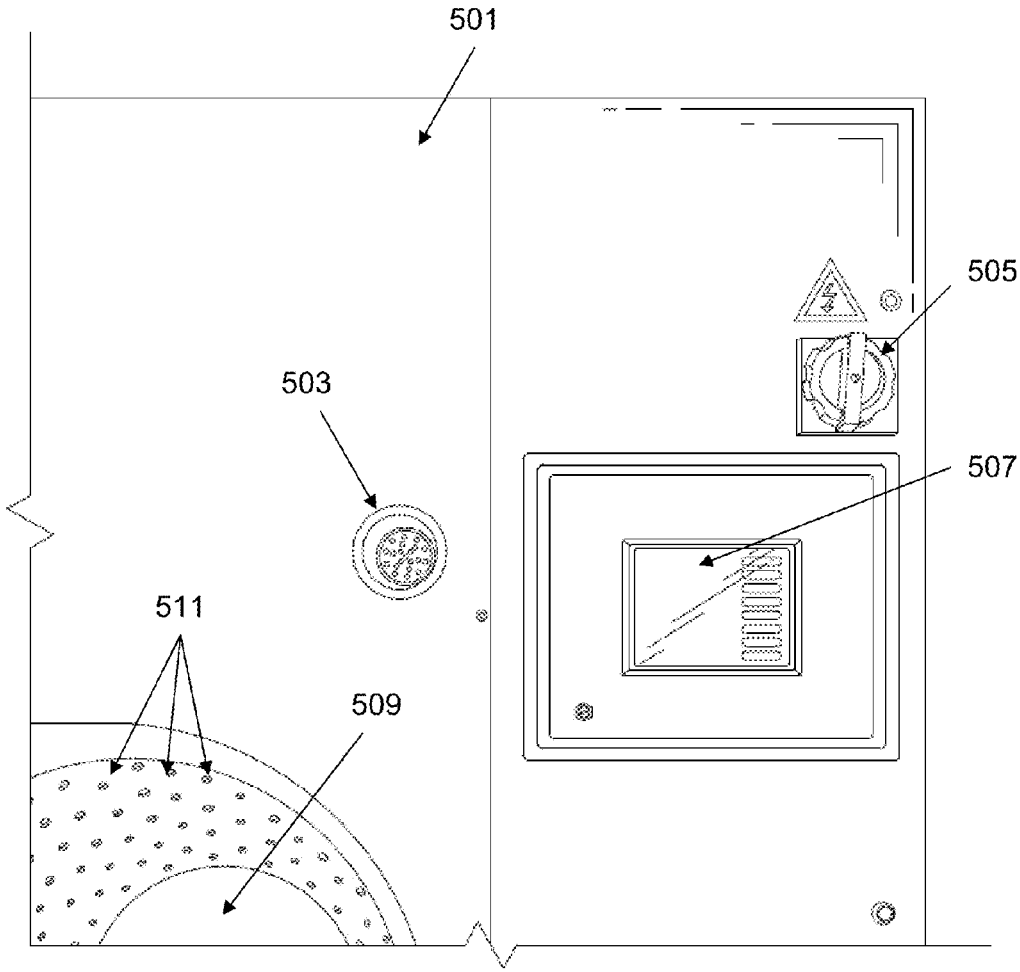
FIG. 5 shows a partial front view of a commercial steam-cleaning laundry machine in accordance with an embodiment of the invention.

FIG. 5 shows a partial front view (500) of a commercial steam-cleaning laundry machine (501) in accordance with an embodiment of the invention. In a preferred embodiment of the invention, a device active/inactive indicator (503) is incorporated to the commercial steam-cleaning laundry machine (501) to conveniently indicate whether the commercial steam-cleaning laundry machine (501) is currently active or inactive even when a user is too far away to read specific information on a user interface of the control panel (507). The control panel (507) is generally designed to allow a user to initiate, select, and/or stop a particular garment cleaning program. One example of the control panel (507) is a touch-screen graphical user interface. Another example of the control panel (507) is a physical button/display combo interface. A plurality of garment cleaning programs is typically programmed into the commercial steam-cleaning laundry machine (501) for a varying duration of clean and rinse cycles and a varying amount of steam injections into the drum. In a preferred embodiment of the invention, the garment cleaning programs are categorized by colors of a laundry load (e.g. whites, bright colors, dark colors, and etc.). In general, a lighter-color laundry load requires more time for cleaning cycles and more steam injections into the drum than a darker-color laundry load.

FIG. 5 also shows micro-holes (511) in an inner surface of a drum (509) for the commercial steam-cleaning laundry machine (501). In one embodiment of the invention, the micro-holes enable more effective cleaning of a laundry load when the drum rotates laterally by accommodating a plurality of air pockets and randomized patterns of steam and moisture movements. Furthermore, in one embodiment of the invention, a main power or an emergency on/off switch (505) allows a user to enable or disable power supply to the commercial steam-cleaning laundry machine (501) directly, thereby allowing the user to bypass menu choices in the control panel (507) to control the power supply immediately in case of an urgent need or emergency.

Figure 6:
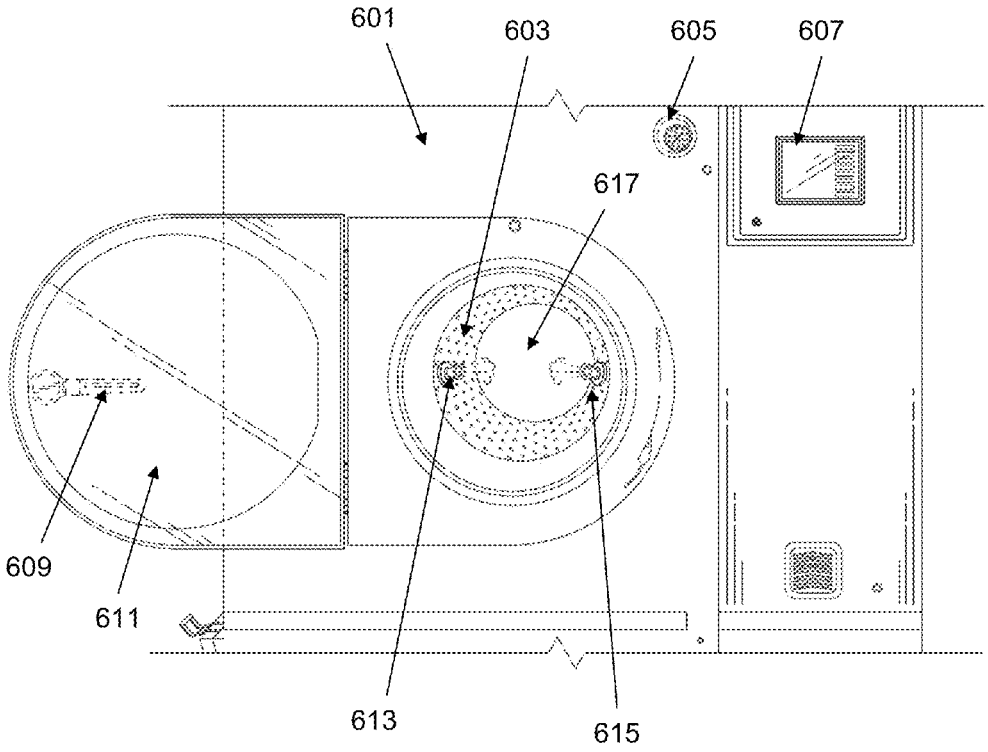
FIG. 6 shows another partial front view of a commercial steam-cleaning laundry machine with steam injectors inside a drum in accordance with an embodiment of the invention.

FIG. 6 shows a partial front view (600) of a commercial steam-cleaning laundry machine (601) with two steam injectors (613, 615) inside a drum (603) in accordance with an embodiment of the invention. In a preferred embodiment of the invention, the two steam injectors (613, 615) face each other at 180-degree angle in an inner surface of the drum. In another embodiment of the invention, the two steam injectors (613, 615) can simply be located in a back portion (617) of the inner surface of the drum (603).

In a preferred embodiment of the invention, the drum (603) also has a front-loading door (611) with a door handle (609) and a viewing area to inspect a laundry load inside. The front-loading door (611) is typically made of metal and glass materials to resist heat and mechanical stress during an operating life of the commercial steam-cleaning laundry machine (601). In addition, the commercial steam-cleaning laundry machine (601) also has a device active/inactive indicator (605) which conveniently indicates whether the commercial steam-cleaning laundry machine (601) is currently active or inactive even when a user is too far away to read specific information on a user interface of the control panel (607).

Figure 7:
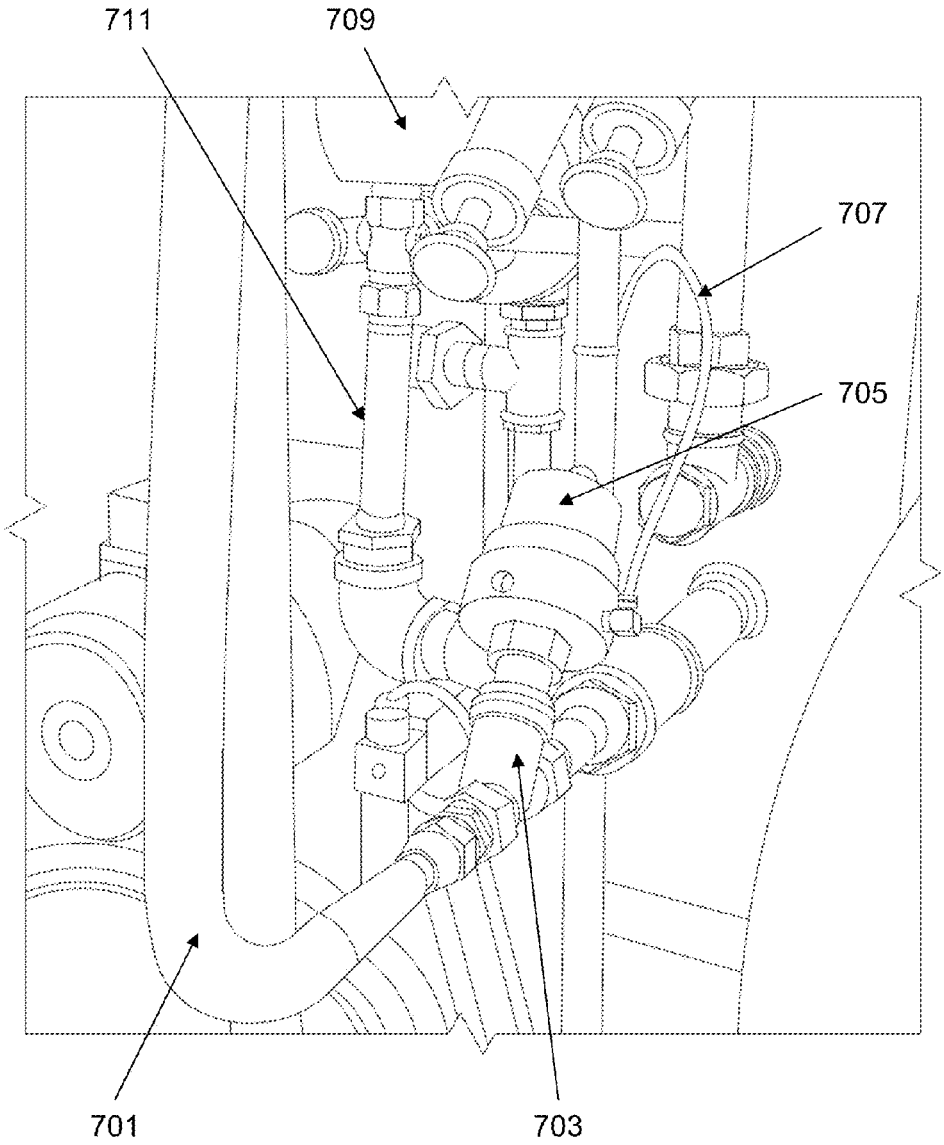
FIG. 7 shows a detailed view of one example of a steam-in duct and a detergent/fabric conditioner input port in accordance with an embodiment of the invention.

FIG. 7 shows a detailed view (700) of one example of a steam-in duct (701) and a detergent/fabric conditioner input port (709) in accordance with an embodiment of the invention. In a preferred embodiment of the invention, the steam-in duct is operatively connected (i.e. 703) to a steam control valve (705), wherein the steam control valve (705) is capable of enabling, disabling, and/or controlling a specific amount of steam pressure injected into one or more steam injectors in an inner surface of a drum. The steam control valve (705) is typically operatively connected (i.e. 707) to a microcontroller (MCU) of a commercial steam-cleaning laundry machine, and the MCU typically controls specific sequences of actions taken by the steam control valve (705). Furthermore, the detergent/fabric conditioner input port (709) is also operatively connected (i.e. 711) to the drum. In one embodiment of the invention, the detergent/fabric conditioner input port (709) shares a same intake pipe with a pressure valve-controlled steam-in duct. In another embodiment of the invention, the detergent/fabric conditioner input port (709) has a separate intake pipe for injecting detergents and/or fabric conditioners into the drum.

Figure 8:
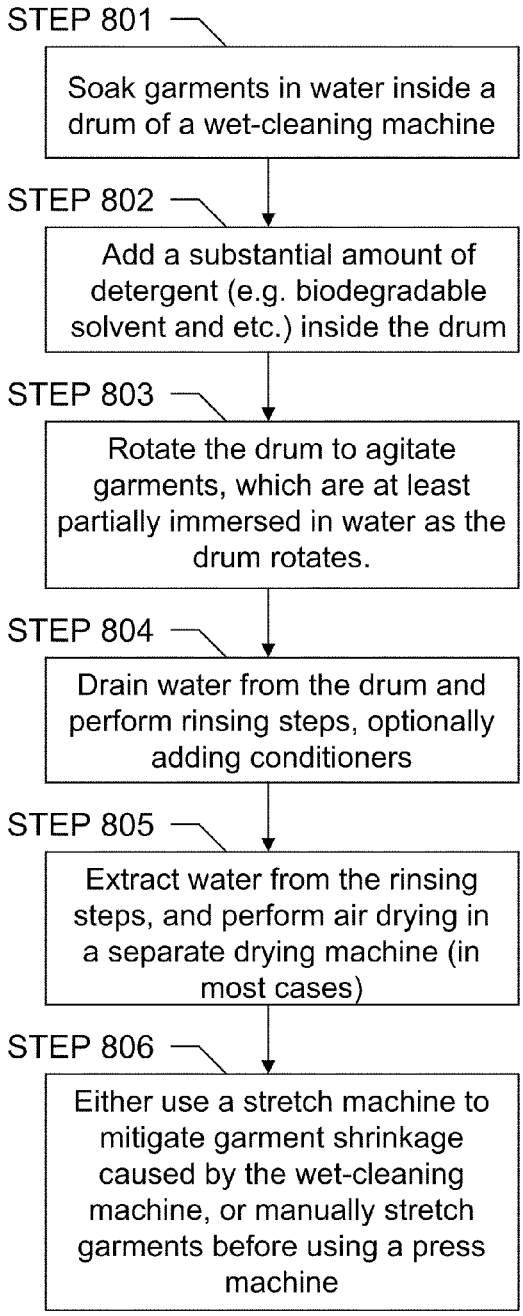
FIG. 8 shows a flow chart for a conventional (i.e. prior art) wet cleaning process in a commercial laundry operation.

FIG. 8 shows a flow chart for a conventional (i.e. prior art) wet cleaning process in a commercial laundry operation. In STEP 801, a wet-cleaning machine soaks garments in water inside a drum of the wet-cleaning machine Then, as shown in STEP 802, a substantial amount of detergent (typically biodegradable solvent and etc.) is added to the water inside the drum. The wet-cleaning machine then rotates the drum to agitate garments which are at least partially immersed in water as the drum rotates, as shown in STEP 803. Then, the mixture of water and detergent is drained out from the drum, a fabric conditioner is optionally added into the contents of the drum, and one or more rinsing steps are repeated, as shown in STEP 804. In STEP 805, the wet-cleaning machine extracts water from the rinsing cycles, and a separate air-drying step using a separate drying machine is required in most cases. In some cases, the wet-cleaning machine itself is capable of performing substantial amount of drying. Finally, in STEP 806, a stretch machine or a manual stretching step is necessary to mitigate garment shrinkage caused by the wet-cleaning machine. This additional "stretching" step which is typically required prior to a press-machine step for a wet-clean process is a labor, capital, and time-intensive bottleneck to a high-volume commercial laundry operation. Equally important, the wet-cleaning machine often damages or shrinks garments beyond an acceptable standard expected by most customers.

Figure 9:
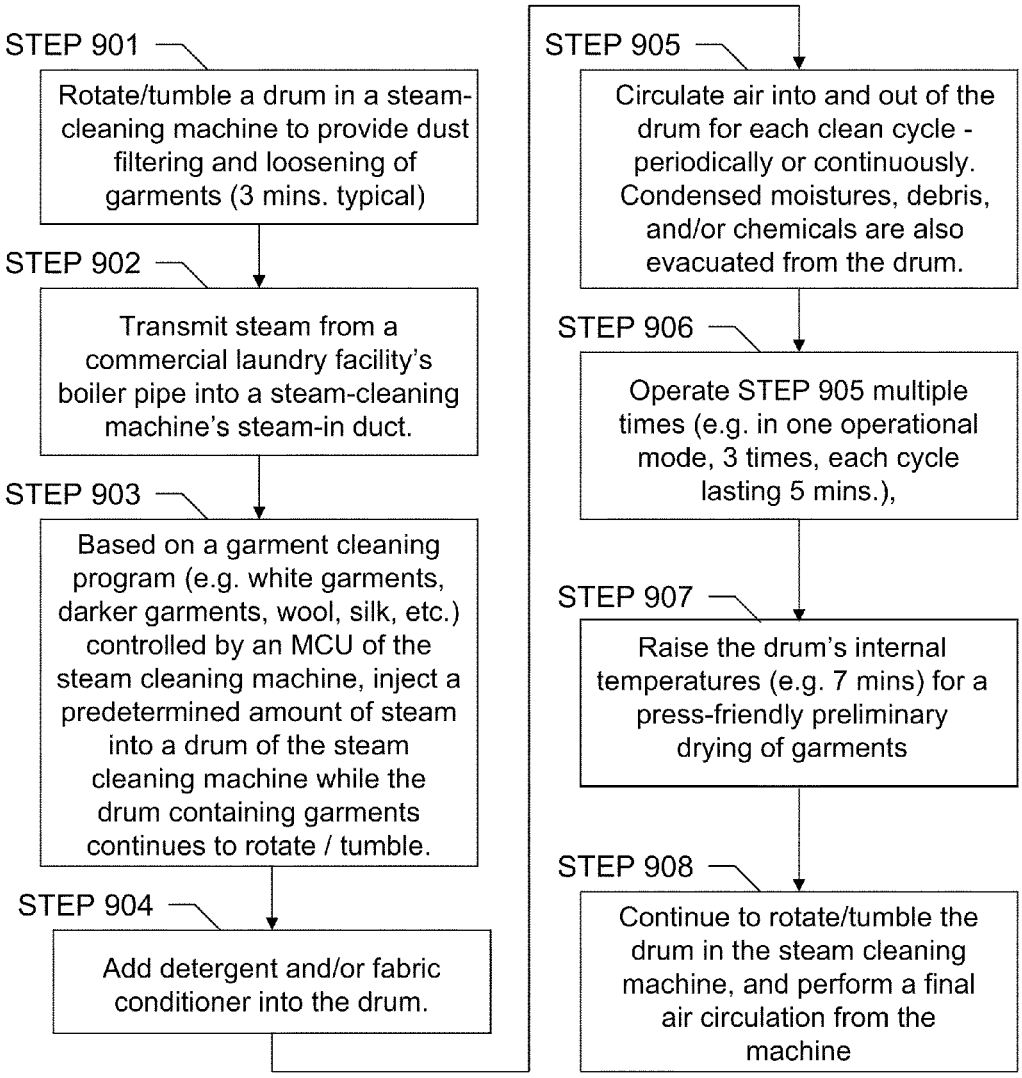
FIG. 9 shows a flow chart for a novel method of using steam as a primary cleaning agent in a steam-cleaning laundry machine in a commercial laundry operation, in accordance with an embodiment of the invention.

In contrast, FIG. 9 shows a flow chart for a novel method of using steam as a primary cleaning agent in a steam-cleaning laundry machine in a commercial laundry operation, in accordance with an embodiment of the invention. In STEP 901, a steam-cleaning laundry machine rotates a drum to provide dust-filtering and loosening of garments. In a preferred embodiment of the invention, 3 minutes are used for this dust-filtering and garment-loosening cycle. Then, in STEP 902, a fresh batch of steam is transmitted from an external boiler system used in a commercial laundry facility to the steam-cleaning laundry machine using a steam-in duct. In a preferred embodiment of the invention, the pressure of the fresh batch of steam is adjusted from a typical boiler outtake pressure of 120 psi to 40 psi to optimize steam injection into the drum of the steam-cleaning laundry machine. Then, in STEP 903, based on a particular garment-cleaning program (e.g. white garments, darker garments, wool, silk, and etc.) controlled by an MCU of the steam-cleaning laundry machine, a predetermined amount of steam is injected into the drum while the drum containing garments continues to rotate at a predetermined speed for a predetermined duration based on the particular garment-cleaning program. In one embodiment of the invention, white or lighter-colored garments require higher amounts of steam injections for effective cleaning, compared to darker-colored garments. In a preferred embodiment of the invention, steam injections into the drum may be periodic. In another embodiment of the invention, the steam injections into the drum may be continuous.

In STEP 904, the steam-cleaning laundry machine adds detergent and/or fabric conditioner into the drum. Then, in STEP 905, the steam-cleaning laundry machine circulates air into and out of the drum for each clean cycle, either periodically or continuously, as the drum continues to rotate. In general, condensed moistures, debris, dirt, and other elements are also evacuated from the drum either periodically or continuously. As shown in STEP 906, STEP 905 may be repeated multiple times depending on a nature of a particular garment-cleaning program. In one example, the cleaning and/or rinsing cycles may be repeated three times. In another example, the cleaning and/or rinsing cycles may be repeated five times. Then, in STEP 907, the drum's internal temperature is raised (e.g. 7 minutes) for a press-friendly preliminary drying of garments. Typically, STEP 907 takes place while the drum continues to rotate at a predetermined pace based on the particular garment-cleaning program currently being executed by the steam-cleaning laundry machine. Then, in STEP 908, the drum continues to rotate in the steam-cleaning laundry machine until a final air circulation is complete.

A significant advantage of the present invention is that the use of steam as a primary agent with a built-in exhaustive material filtering feature (e.g. a debris and clean steam/air separation chamber, a debris container, and etc.) enables an eco-friendly evacuation of clean or "cleaned-up" air and steam to the environment. Not only does a novel commercial steam-cleaning laundry machine disclosed in the present invention provide an environmentally-friendly solution to the commercial laundry industry, but it also reduces operating costs of a commercial laundry facility by minimizing pollution-related regulatory procedures. In contrast, a chemical-based (e.g. perc) dry cleaning machine faces increasingly stringent environmental restrictions, inspections, and equipment costs which act as a time-consuming and substantial cost overhead to an overall profitability of a commercial laundry.

Furthermore, another significant advantage of the present invention is that the commercial steam-cleaning laundry machine typically requires substantially smaller amount of water usage relative to a conventional, water-based "wet cleaning" machine A resulting water conservation achieved by the present invention is another critical factor in preserving the environment, especially in parts of the world (e.g. arid western parts of the United States such as California, Arizona, New Mexico, and Nevada) with relatively scarce regional water resources. Equally important, cleaned garments from the commercial steam-cleaning laundry machine typically experience less wrinkles and shrinkages compared to the conventional water-based wet cleaning machines, which translates to less preparation time and effort prior to using a laundry press machine for garments in a commercial laundry operation.

In addition, it should be noted that most wet cleaning machines in the market today require a refrigeration unit for cooling and drying a laundry load, which add manufacturing costs and ultimately an end-product cost to a commercial laundry owner. In contrast, the commercial steam-cleaning laundry machine disclosed in the present invention does not require many of the extraneous components such as the refrigeration unit, thereby resulting in cost savings for its manufacturer and customers. Moreover, by utilizing an external water boiler system which is typically present anyway in a commercial laundry facility due to the necessity of the external water boiler system for laundry press machines, the commercial steam-cleaning laundry machine does not have to embed an internal water boiler unit. The use of the internal water boiler unit for steam generation would have been expensive to operate in case of an embedded electrical boiler due to the cost of electricity for heating water, or expensive to manufacture and operate in case of an embedded gas-fired water boiler. Therefore, a novel utilization of an existing external water boiler system in a commercial laundry facility for steam intake in a novel commercial steam-cleaning laundry machine as devised in the present invention further achieves cost savings for its manufacturer and customers.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A commercial steam-cleaning laundry machine configured to use steam as a primary cleaning agent for garments, the commercial steam-cleaning laundry machine comprising:

a drum operatively connected to a front-loading door and a drum motor of the commercial steam-cleaning laundry machine, wherein the drum is configured to rotate inside the commercial steam-cleaning laundry machine by a rotational force provided by the drum motor;

a steam injector at least partially exposed to an inner surface of the drum, wherein the steam injector is configured to provide a microcontroller (MCU)-controlled fresh steam injection into the drum during a cleaning cycle of the commercial steam-cleaning laundry machine;

a steam-in duct operatively connected to the steam injector and an external water boiler system outside the commercial steam-cleaning laundry machine, wherein the steam-induct is configured to carry fresh steam produced from the external boiler system outside the commercial steam-cleaning laundry machine into the steam injector of the commercial steam-cleaning laundry machine;

a control panel operatively connected to the microcontroller (MCU) of the commercial steam-cleaning laundry machine, wherein the control panel enables a user to select, initiate, or halt a particular garment-cleaning program using steam as the primary cleaning agent;

an air-in duct operatively connected to the drum, wherein the air-in duct is configured to bring fresh outside air continuously or periodically during an operation of the particular garment-cleaning program to condense the steam onto the garments;

a debris and clean steam/air separation chamber operatively connected to an outtake port inside the drum, wherein the debris and clean steam/air separation chamber is designed to separate, filter, and/or clean an incoming mixture of debris, steam, moisture, chemicals and/or air from the drum; and an air-out duct operatively connected to the debris and clean steam/air separation chamber, wherein the air-out duct is configured to evacuate filtered and/or cleaned steam, air, and/or condensed water from the debris and clean steam/air separation chamber.

2. The apparatus of claim 1, further comprising a detergent and/or fabric conditioner input port operatively connected to the drum.

3. The apparatus of claim 2, wherein the steam injector and the detergent and/or fabric conditioner input port are enabled, disabled, and/or pressured-controlled by the microcontroller (MCU) of the commercial steam-cleaning laundry machine based on the particular garment cleaning program currently executed by the microcontroller.

4. The apparatus of claim 1, further comprising a debris and clean steam/air separation cylinder operatively connected to the debris and clean steam/air separation chamber and the air-out duct, wherein the debris and clean steam/air separation cylinder provides an additional level of filtering, cleaning, and/or separation of undesirable or environmentally harmful debris, steam, moisture, chemicals, and/or air.

5. The apparatus of claim 1, further comprising a debris collection pipe, a debris container pipe, and a debris container which are operatively connected to the debris and clean steam/air separation chamber, wherein the debris container is configured to collect the environmentally harmful debris, steam, moisture, chemicals, and/or air.

6. The apparatus of claim 1, further comprising a debris collection pipe and a disk filter/distillation tank unit which are operatively connected to the debris and clean steam/air separation chamber, wherein the disk filter/distillation tank unit is capable of boiling and evaporating moistures coming into the debris and clean steam/air separation chamber using a heat coil.

7. The apparatus of claim 1, further comprising a chamber filter container placed inside the debris and clean steam/air separation chamber, wherein the chamber filter container includes a debris and clean steam/air filter.

8. The apparatus of claim 1, wherein the control panel comprises a touch-screen display and/or a graphical user interface to enable the user to select, initiate, or halt the particular garment cleaning program.

9. The apparatus of claim 1, wherein the particular garment cleaning program comprises a combination of cleaning, rinsing, and/or drying cycles with varying amounts of steam injection, cycle frequencies, and cycle durations based on a color and/or a type of garments for a particular load of laundries.

10. The apparatus of claim 1, further comprising a pressure controller operatively connected to the steam-in duct and/or the steam injector.

11. A commercial steam-cleaning laundry machine configured to use steam as a primary cleaning agent for garments, the commercial steam-cleaning laundry machine comprising:

a drum operatively connected to a front-loading door and a drum motor of the commercial steam-cleaning laundry machine, wherein the drum is configured to rotate inside the commercial steam-cleaning laundry machine by a rotational force provided by the drum motor;

a first steam injector and a second steam injector at least partially exposed to an inner surface of the drum, wherein the first steam injector and the second steam injector are configured to provide a microcontroller (MCU)-controlled fresh steam injection into the drum during a cleaning cycle of the commercial steam-cleaning laundry machine;

a steam-in duct operatively connected to the first steam injector, the second steam injector, and an external water boiler system outside the commercial steam-cleaning laundry machine, wherein the steam-induct is configured to carry fresh steam produced from the external boiler system outside the commercial steam-cleaning laundry machine into the first steam injector and the second steam injector of the commercial steam-cleaning laundry machine;

a control panel operatively connected to the microcontroller (MCU) of the commercial steam-cleaning laundry machine, wherein the control panel enables a user to select, initiate, or halt a particular garment-cleaning program using steam as the primary cleaning agent;

an air-in duct operatively connected to the drum, wherein the air-in duct is configured to bring fresh outside air continuously or periodically during an operation of the particular garment-cleaning program to condense the steam onto the garments;

a debris and clean steam/air separation chamber operatively connected to an outtake port inside the drum, wherein the debris and clean steam/air separation chamber is designed to separate, filter, and/or clean an incoming mixture of debris, steam, moisture, chemicals and/or air from the drum; and an air-out duct operatively connected to the debris and clean steam/air separation chamber, wherein the air-out duct is configured to evacuate filtered and/or cleaned steam, air, and/or condensed water from the debris and clean steam/air separation chamber.

12. The apparatus of claim 11, wherein at least some portions of the first steam injector and the second steam injector directly face each other at 180-degrees inside the drum.

13. The apparatus of claim 11, further comprising a detergent and/or fabric conditioner input port operatively connected to the drum.

14. The apparatus of claim 13, wherein the first steam injector, the second steam injector, and the detergent and/or fabric conditioner input port are enabled, disabled, and/or pressured-controlled by the microcontroller (MCU) of the commercial steam-cleaning laundry machine based on the particular garment cleaning program currently executed by the microcontroller.

15. The apparatus of claim 11, further comprising a debris and clean steam/air separation cylinder operatively connected to the debris and clean steam/air separation chamber and the air-out duct, wherein the debris and clean steam/air separation cylinder provides an additional level of filtering, cleaning, and/or separation of undesirable or environmentally harmful debris, steam, moisture, chemicals, and/or air.

16. The apparatus of claim 11, further comprising a debris collection pipe, a debris container pipe, and a debris container which are operatively connected to the debris and clean steam/air separation chamber, wherein the debris container is configured to collect the environmentally harmful debris, steam, moisture, chemicals, and/or air.

17. The apparatus of claim 11, further comprising a chamber filter container placed inside the debris and clean steam/air separation chamber, wherein the chamber filter container includes a debris and clean steam/air filter.

18. The apparatus of claim 11, further comprising a debris collection pipe and a disk filter/distillation tank unit which are operatively connected to the debris and clean steam/air separation chamber, wherein the disk filter/distillation tank unit is capable of boiling and evaporating moistures coming into the debris and clean steam/air separation chamber using a heat coil.

* * * * *